US008296904B2

(12) United States Patent
Yang

(10) Patent No.: US 8,296,904 B2
(45) Date of Patent: Oct. 30, 2012

(54) HINGE ASSEMBLY AND ILLUMINATION DEVICE UTILIZING THE SAME

(75) Inventor: Wen-Yan Yang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 315 days.

(21) Appl. No.: 12/752,134

(22) Filed: Apr. 1, 2010

(65) Prior Publication Data

US 2011/0047752 A1 Mar. 3, 2011

(30) Foreign Application Priority Data

Aug. 26, 2009 (CN) ..... 2009 1 0306125

(51) Int. Cl.
*E05C 17/64* (2006.01)

(52) U.S. Cl. ..... 16/337; 16/366; 16/367

(58) Field of Classification Search ..... 16/337, 16/367, 371, 287, 282, 366, 286; 248/288.11, 248/291.1, 274.1
See application file for complete search history.

(56) References Cited

U.S. PATENT DOCUMENTS

| | | | | |
|---|---|---|---|---|
| 2,694,585 | A * | 11/1954 | Fiori | 403/120 |
| 6,347,433 | B1 * | 2/2002 | Novin et al. | 16/367 |
| 7,559,518 | B2 * | 7/2009 | Ye | 248/288.11 |
| 2004/0006848 | A1 * | 1/2004 | Hsu | 16/367 |
| 2010/0282923 | A1 * | 11/2010 | Wang et al. | 248/158 |
| 2010/0299876 | A1 * | 12/2010 | Kang | 16/319 |
| 2011/0141737 | A1 * | 6/2011 | Gu et al. | 362/249.1 |

* cited by examiner

*Primary Examiner* — Victor Batson
*Assistant Examiner* — Matthew Sullivan
(74) *Attorney, Agent, or Firm* — Altis Law Group, Inc.

(57) ABSTRACT

A hinge assembly includes an axel and a conversion adapter including a hollow column and a hollow protrusion pole. The hollow column communicates with the hollow protrusion pole. A pivoting element is rotatably connected to the conversion adapter, and includes a first side plate and a connection plate. A positioning pole is protruded from the first side plate. A protrusion ring and a guide pole are protruded from the connection plate. A rotation element is rotatably placed over the axel. The protrusion ring is rotatably placed over the protrusion pole. The rotation element is rotatably placed over the guide pole.

13 Claims, 6 Drawing Sheets

HINGE ASSEMBLY AND ILLUMINATION DEVICE UTILIZING THE SAME

BACKGROUND

1. Technical Field

The present disclosure relates to illumination devices and, particularly, to an illumination device unitizing a hinge assembly.

2. Description of Related Art

Some illumination devices include an illumination portion, a deformable connection pole, and a lamp holder. Users can adjust the deformable connection pole to change an illumination angle and an illumination range of the illumination device. However, a long time operation on the connection pole results in a weak deformability for the connection pole, thereby shortening the service life of the illumination device.

Therefore, what is needed is an illumination device with a hinge assembly to overcome the described shortcoming.

DETAILED DESCRIPTION

Figure 1:
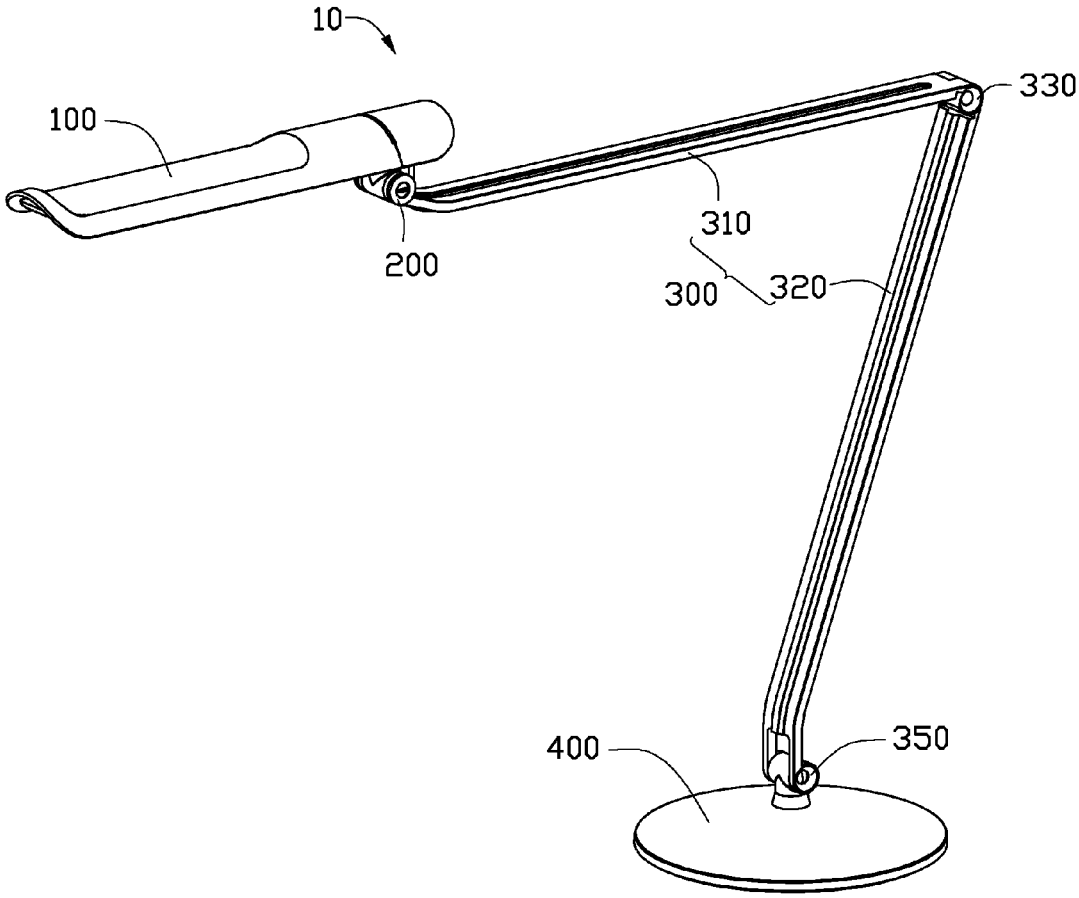
FIG. 1 is an isometric view of one embodiment of an illumination device including a hinge assembly.

Referring to FIG. 1, an embodiment of an illumination device 10 is illustrated. The illumination device 10 includes an illumination portion 100, a hinge assembly 200, a support portion 300, and a base 400. The illumination portion 100 is rotatably connected to the support portion 300 by the hinge assembly 200. The support portion 300 is rotatably connected to the base 400, and configured for supporting the illumination portion 100. The base 400 is circular platform, and is configured for contacting with a support surface, such as a desktop.

The support portion 300 includes a first connection pole 310, a second connection pole 320, a first hinge 330, and a second hinge 350. The first connection pole 310 is rotatably connected to the second connection pole 320 by the first hinge 330. The first connection pole 310 is configured for adjusting an angle formed between the first connection pole 310 and the second connection pole 320 by a friction force among the first hinge 330, the first connection pole 310, and the second connection pole 320. The second connection pole 320 is rotatably connected to the base 400 by the second hinge 350, and is configured for adjusting an angle formed between the second connection pole 320 and the base 400 by the friction force among the second hinge 350, the second connection pole 320, and the base 400.

Figure 2:
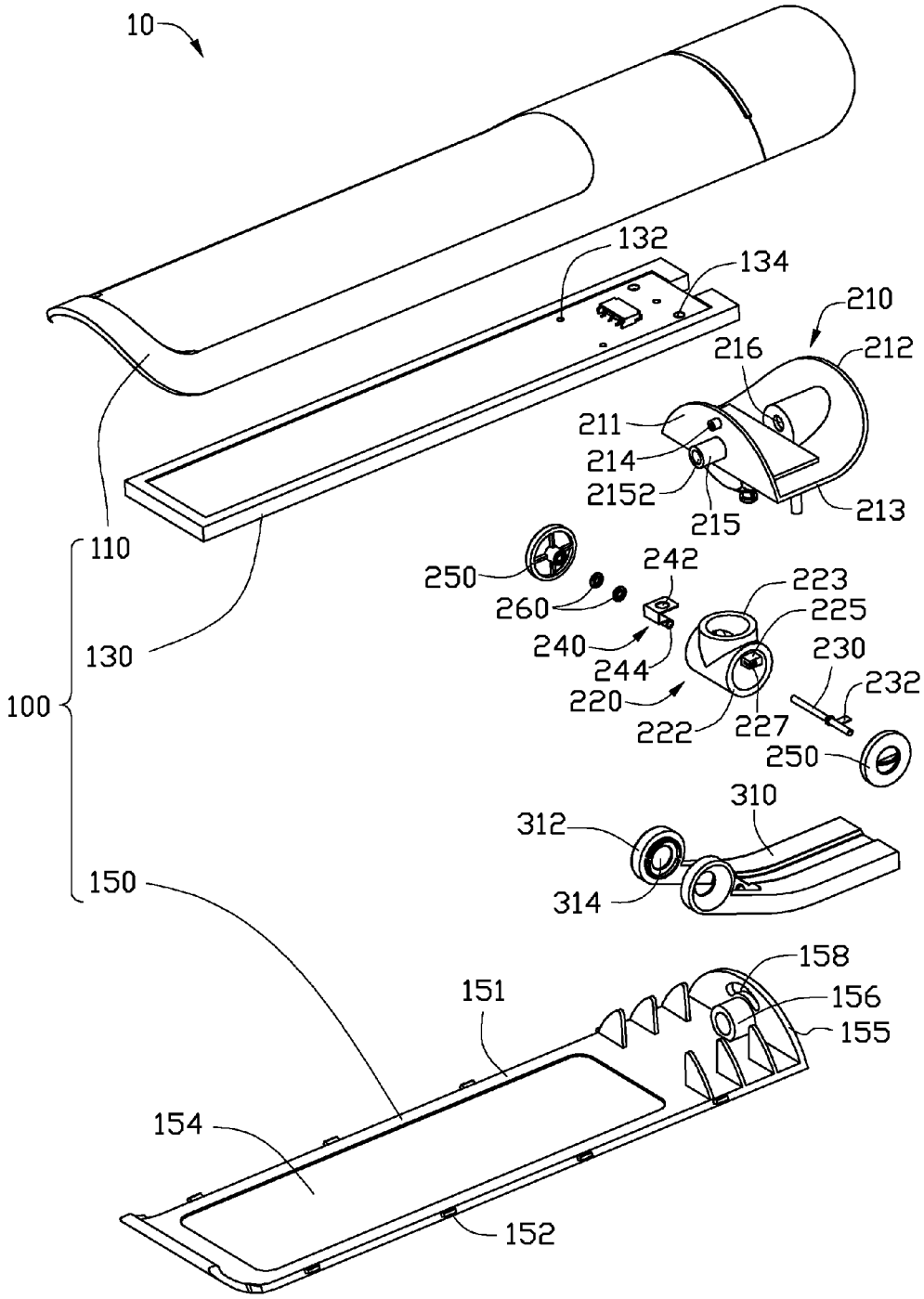
FIG. 2 is a partial, exploded view of the illumination device of FIG. 1.
Figure 3:
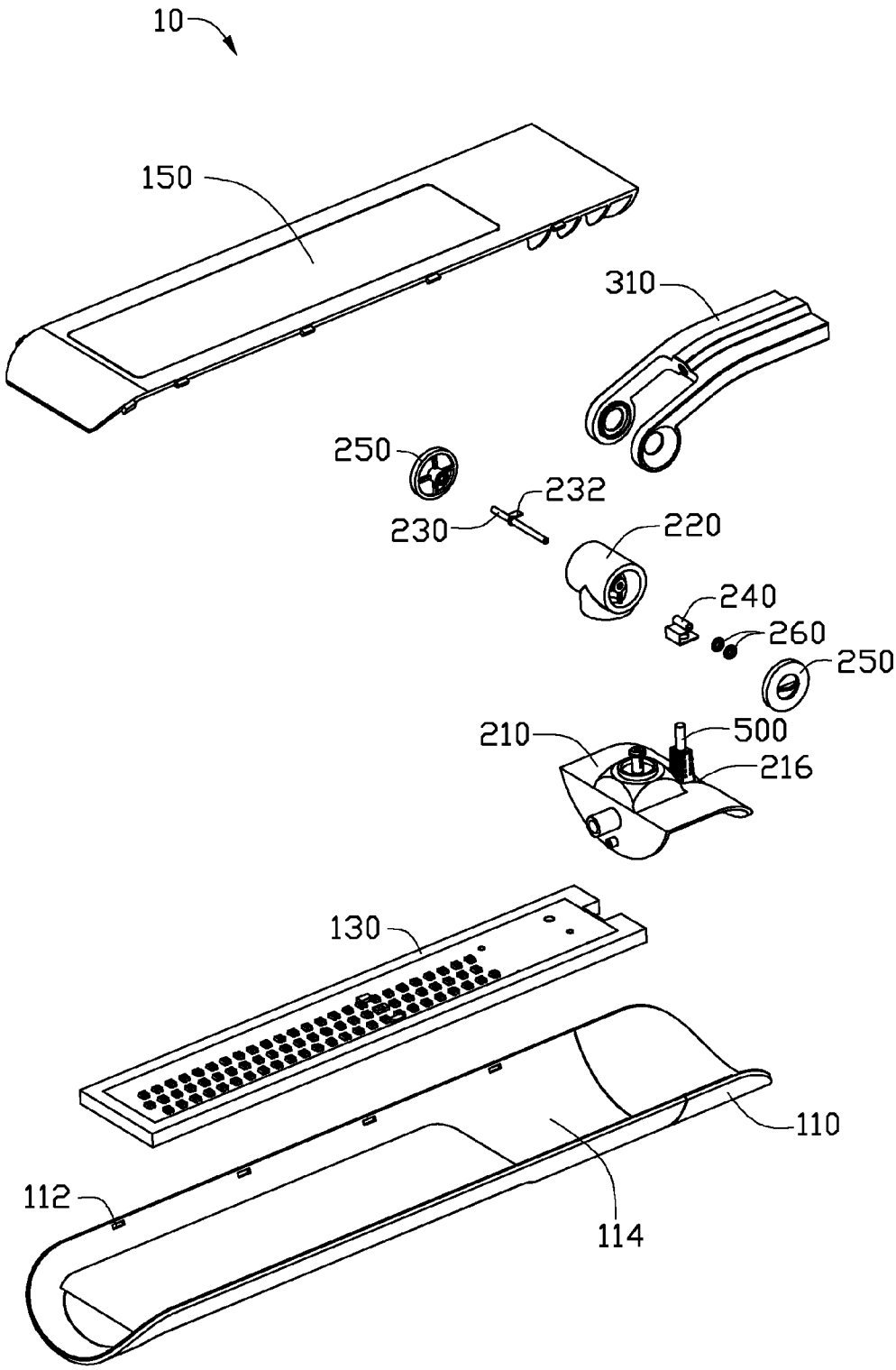
FIG. 3 is schematic diagram of the illumination device of FIG. 2, from an another aspect.
Figure 4:
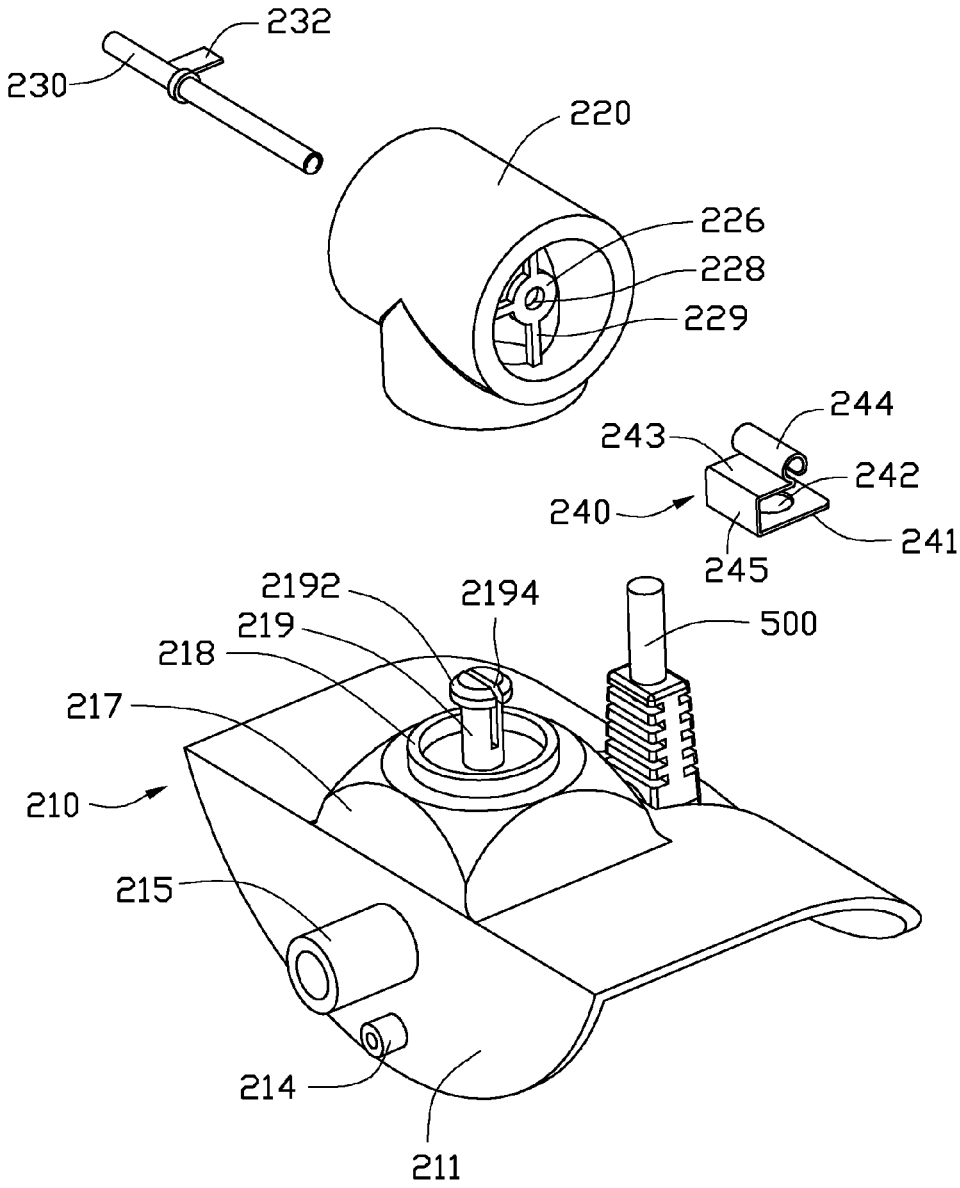
FIG. 4 is a partial, enlarged view of the hinge assembly of FIG. 1.

Referring to FIGS. 2-4, the illumination portion 100 includes an upper cover 110, a connecting board 130, and a lower cover 150. The cross section of the upper cover 110 is cambered. The upper cover 110 is made of light-tight martial, such as plastic or metal. A plurality of grooves 112 are defined in two opposite sides of the inner surface 114 of the upper cover 100. A lamp pipe (not shown) is set in the connecting board 130.

The connecting board 130 is electrically connected to a power supply (not shown) by a wire 500, and is configured for providing a power for the lamppipe. The connecting board 130 also defines a plurality of threaded holes 132 for connecting the connecting board 130 to the lower cover 150.

The lower cover 150 includes a bottom plate 151 and a side plate 155. The bottom plate 151 is substantially rectangular. The side plate 155 is located on an end portion of the bottom plate 151 and is vertical to the bottom plate 151. A plurality of protrusions 152 corresponding to the grooves 112 are protruded from the edge of the bottom plate 151. The bottom plate 151 also defines a square opening 154 for holding a transparent shield, such as glass, to prevent the dust. The side plate 155 is cambered. A limitation hole 158 is defined in the side plate 155 away from the bottom plate 151. A circular through hole 156 is defined between the limitation hole 158 and the bottom plate 151.

The hinge assembly 200 is configured for pivoting the illumination portion 100 into the support portion 300. The hinge assembly 200 includes a pivoting element 210, a conversion adapter 220, an axle 230, and a rotation element 240. The pivoting element 210 is rotatably pivoted into the conversion adapter 220. The axle 230 is rotatably pivoted into the conversion adapter 220. The rotation element 240 is fixedly connected to the axle 230, and is received into the inside of the conversion adapter 220.

The pivoting element 210 includes a first side plate 211, a second side plate 212, and a connection plate 213 connected to the first side plate 211 and the second side plate 212. The first side plate 211 is cambered, and is vertical to the connection plate 213. A limitation pole 214 and a column positioning pole 215 between the limitation pole 214 and the connection plate 213 are protruded from one side of the first side plate 211 away from the second side plate 212. The positioning pole 215 defines a threaded hole 2152. The limitation pole 214 and the positioning pole 215 are vertical to the first side plate 211. The second side plate 212 defines a hole 216 for passing by the wire 500.

A protrusion block 217 is protruded from one side of the connection plate 213 away from the first side plate 211 and the second side plate 212. A protrusion ring 218 and a guide pole 219 are protruded from the protrusion block 217. The guide pole 219 is set in the center (not shown) of the protrusion ring 218. The distal end of the guide pole 219 forms a circular flange 2192 whose diameter exceeds that of the guide pole 219. A slit 2194 is cut from the distal end of the guide pole 219 along an axel direction of the guide pole 219. The flange 2192 is divided into two same portions by the slit 2194. When an external force is applied on the flange 2192, the two portions of the flange 2192 are driven to close together along the axel direction of the guide pole 219, that is, the diameter of the flange 2192 is decreased.

The conversion adapter 220 is T shaped, and includes a hollow column 222. A hollow protrusion pole 223 is protruded from the center portion of the column 222. The inner cavity of the protrusion pole 223 communicates with the inner cavity of the column 222, and the outer diameter of the protrusion pole 223 approximately equals the inner diameter of the protrusion ring 218. The column 222 further includes a stopping portion 225 and a bearing element 226. The stopping portion 225 is fixed to the inner side plate of the column 222, and defines a limitation groove 227. The bearing element 226 is fixed to the inner surface of the column 222 by at least two support poles 229. The bearing element 226 defines a second circular axel hole 228.

The axel 230 is passed through the second circular axel hole 228, and is rotatably connected to the conversion adapter 220. The axel 230 includes a stopping element 232 vertically connected to the side plate of the axel 230.

The rotation element 240 includes a fixing portion 241, a housing portion 243, and a connection portion 245 connected to the fixing portion 241 and the housing portion 243. The fixing portion 241 is vertical to the connection portion 245, and defines a circular perforation 242. One end of the housing portion 243 away from the connection portion 245 forms a sleeve 244. The rotation element 240 is rotatably placed over the axel 230 by the sleeve 244.

The hinge assembly 200 further includes a plurality of nuts 250 fixed to two ends of the axel 230, and a plurality of shims 260.

Two opposite connection elements 312 are formed in one end of the first connection pole 310. Two opposite first axel holes 314 are defined in the two connection elements 312 respectively.

When assembling, firstly, the rotation element 240 is placed in the inside of the column 222, and the column 222 of the conversion adapter 220 is placed between the two first axel holes 314, so that, the center of circle of the second axel hole 228 and the two first axel holes 314 locates in the axial line of the column 222. The axel 230 is passed through the first axel hole 314, the sleeve 244, the second axel hole 228 and the shims 260, and the stopping element 232 is locked inside of the limitation groove 227. Two ends of the axel 230 are screwed onto the two nuts 250, thereby rotatably connecting the conversion adapter 220 to the first connection pole 310. Secondly, the protrusion ring 218 is received into the protrusion pole 223, and the flange 2192 of the guide pole 219 is engaged into the perforation 242 of the rotation element 240. Accordingly, the pivoting element 210 is rotatably connected to the conversion adapter 220. Thirdly, the positioning pole 215 is passed through the through hole 156, and the limitation pole 214 is passed through the limitation hole 158. The fixing element (not shown) such as, pin, is screwed into the threaded hole 2152, thereby rotatably connecting the lower cover 150 to the pivoting element 210, and limiting the movement of the lower cover 150 along the axial direction of the positioning pole 215. The limitation hole 158 is configured for limiting a rotation angle of the lower cover 150 relative to the positioning pole 215. Fourthly, the bolt (not shown) is passed through the threaded hole 132 to fix the connecting board 130 to the lower cover 150. The grooves 112 cooperate with the protrusions 152 to engage the upper cover 110 into the lower cover 150, thereby completely assembling the illumination portion 100.

Figure 5:
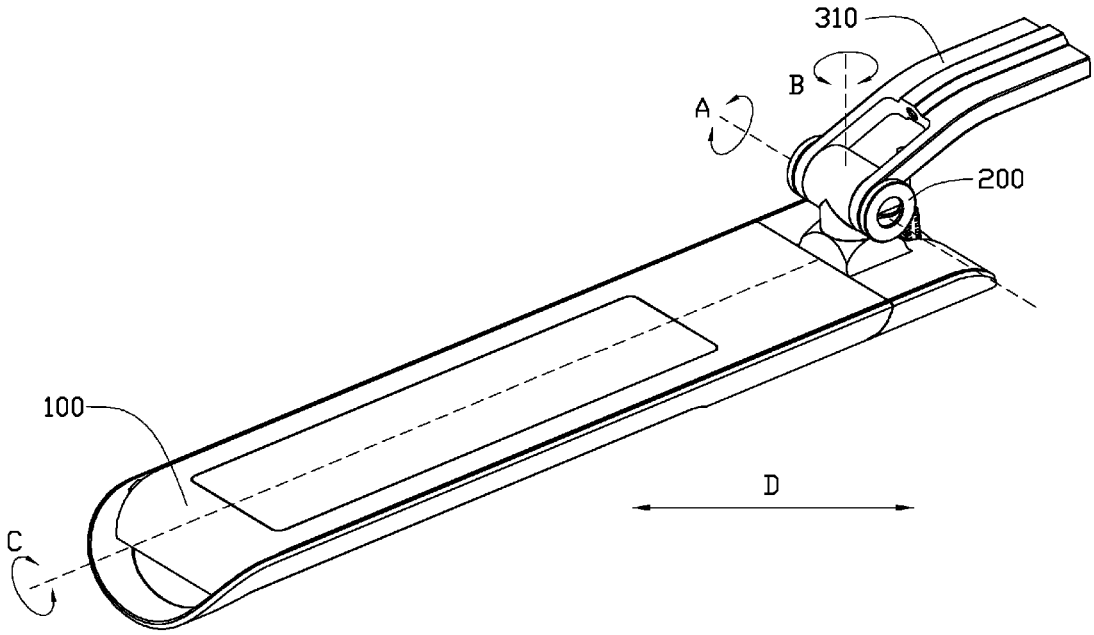
FIG. 5 is an assembled view of the illumination device of FIG. 2.
Figure 6:
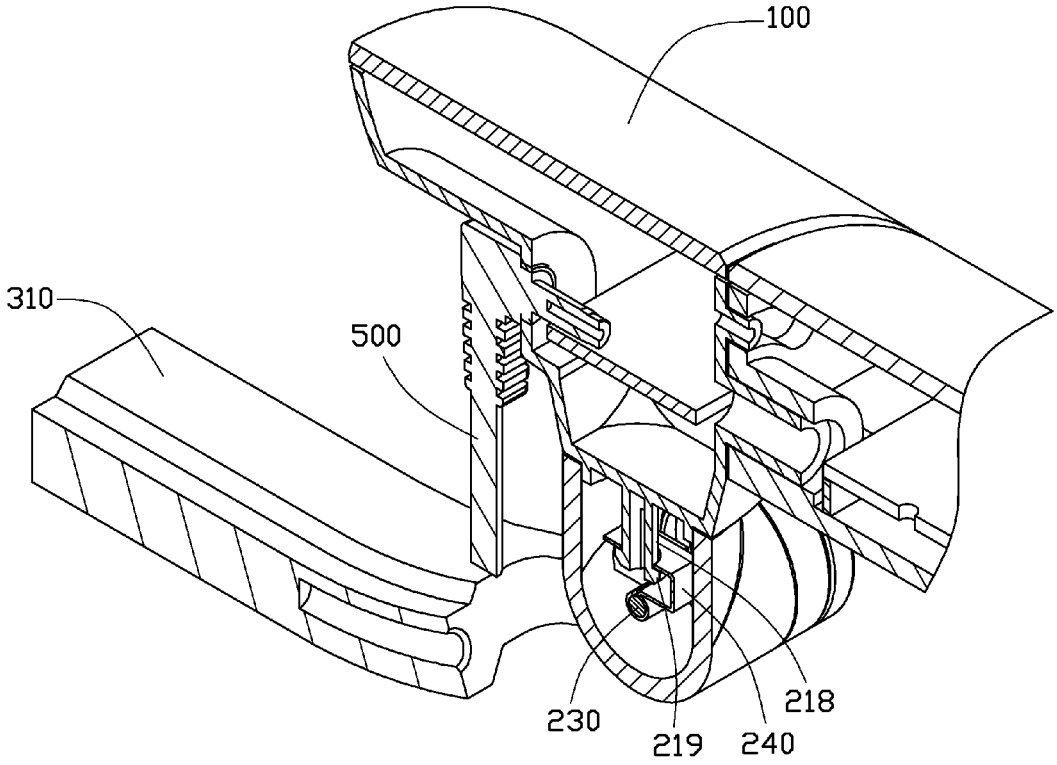
FIG. 6 is a cross-sectional view of the illumination device of FIG. 5.

Referring to FIGS. 5-6, after assembling, because the illumination portion 100 is rotatably connected to the first connection pole 310 by the hinge assembly 200, the illumination portion 100 is rotatable along the direction A. Because the illumination portion 100 is rotatably connected to the conversion adapter 220 by the pivoting element 210, the illumination portion 100 is rotatable along the direction B. Because the lower cover 150 is rotatably connected to the pivoting element 210, the illumination portion 100 is rotatable along the direction C. Because the illumination portion 100 is rotatably connected to the base 400 by the support portion 300, the illumination portion 100 is rotatable along the direction D.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A hinge assembly comprising:

a conversion adapter comprising a hollow column and a hollow protrusion pole, wherein the hollow column communicates with the hollow protrusion pole;

a pivoting element rotatably connected to the conversion adapter, and comprising a first side plate, a connection plate, a positioning pole, a protrusion block, a protrusion ring, a guide pole, and a flange, wherein the positioning pole is protruded from the first side plate, the protrusion block is protruded from the connection plate, and the protrusion ring and the guide pole are protruded from the protrusion block, the guide pole is set in the center of the protrusion ring, the flange is formed in a distal end of the guide pole;

an axel; and a rotation element rotatably placed over the axel;

wherein, the protrusion ring is rotatably placed over the protrusion pole, and the rotation element is rotatably placed over the guide pole.

2. The hinge assembly as described in claim 1, wherein the axel comprises a stopping element, the column comprises a bearing element and a limitation groove, the stopping element is locked in the limitation groove, and the axel is passed through the bearing element to connect to the conversion adapter.

3. The hinge assembly as described in claim 1, wherein the conversion adapter is T shaped, and the protrusion pole is protruded perpendicularly from the column.

4. The hinge assembly as described in claim 1, wherein the rotation element is received into the conversion adapter, and comprises a fixing portion, a housing portion, and a connection portion connected to the fixing portion and the housing portion, the fixing portion defines a circular perforation, a sleeve is set in one end of the housing portion away from the connection portion, the flange of the guide pole is engaged into the perforation, and the rotation element is rotatably placed over the axel by the sleeve.

5. The hinge assembly as described in claim 1, wherein the first side plate is approximately vertical to the connection plate.

6. The hinge assembly as described in claim 1, wherein a slit is cut from the distal end of the guide pole along an axel direction of the guide pole, and divides the flange into two identical portions.

7. An illumination device comprising:

a base;

a support portion rotatably connected to the base, wherein the support portion comprises a first connection pole, a second connection pole, a first hinge and a second hinge, the first connection pole is rotatably connected to the second connection pole by the first hinge, the second connection pole is rotatably connected to the base by the second hinge;

an illumination portion rotatably connected to the first connection pole; and a hinge assembly comprising a conversion adapter rotatably connected to the support portion, and comprising a hollow column and a hollow protrusion pole, wherein the column communicates with the protrusion pole;

a pivoting element rotatably connected to the conversion adapter, and comprising a first side plate and a connection plate, wherein a circular positioning pole is protruded from the first side plate, and a protrusion ring and a guide pole are protruded from the connection plate;

an axel; and a rotation element rotatably placed over the axel;

wherein, the illumination portion is rotatably pivoting element by the positioning pole, the protrusion ring is rotatably placed over the protrusion pole, and the rotation element is rotatably placed over the guide pole.

8. The illumination device as described in claim 7, wherein the axel comprises a stopping element, the column comprises a bearing element and a limitation groove, the stopping element is locked in the limitation groove, and the axel is passed through the bearing element to connect to the conversion adapter.

9. The illumination device as described in claim 7, wherein the conversion adapter is T shaped, and the protrusion pole is protruded perpendicularly from the column.

10. The illumination device as described in claim 7, wherein a protrusion block is protruded from the connection plate, the protrusion ring and the guide pole are protruded from the protrusion block, the guide pole is set in the center of the protrusion ring, a flange is formed in an distal end of the guide pole.

11. The illumination device as described in claim 10, wherein the rotation element is received into the conversion adapter, and comprises a fixing portion, a housing portion, and a connection portion connected to the fixing portion and the housing portion, the fixing portion defines a circular perforation, a sleeve is set in one end of the housing portion away from the connection portion, the flange of the guide pole is engaged into the perforation, and the rotation element is rotatably placed over the axel by the sleeve.

12. The illumination device as described in claim 7, wherein the first side plate is approximately vertical to the connection plate, and a limitation pole is protruded from the first side plate to limit a rotation range of the illumination portion.

13. The illumination device as described in claim 7, wherein a slit is cut from the distal end of the guide pole along an axel direction of the guide pole, and divides the flange into two identical portions.

* * * * *